US010351403B2

(12) United States Patent
Jackson et al.

(10) Patent No.: US 10,351,403 B2
(45) Date of Patent: Jul. 16, 2019

(54) PRY BAR ASSEMBLY

(71) Applicants: Daniel P. Jackson, Emmett, MI (US); Lisa M. Jackson, Emmett, MI (US)

(72) Inventors: Daniel P. Jackson, Emmett, MI (US); Lisa M. Jackson, Emmett, MI (US)

( * ) Notice: Subject to any disclaimer, the term of this patent is extended or adjusted under 35 U.S.C. 154(b) by 48 days.

(21) Appl. No.: 15/158,821

(22) Filed: May 19, 2016

(65) Prior Publication Data

US 2017/0334697 A1 Nov. 23, 2017

(51) Int. Cl.

| | |
|---|---|
| ***B25G 1/04*** | (2006.01) |
| ***B25G 3/24*** | (2006.01) |
| ***B25C 11/00*** | (2006.01) |
| ***B66F 15/00*** | (2006.01) |

(52) U.S. Cl.

CPC ..... *B66F 15/00* (2013.01); *B25C 11/00* (2013.01); *B25G 1/04* (2013.01); *B25G 3/24* (2013.01); *Y10T 16/4719* (2015.01)

(58) Field of Classification Search

CPC ..... B25C 11/00; B66F 15/00; E04G 23/08; E04G 2023/085; Y10T 16/469; Y10T 16/4713; Y10T 16/4719; Y10T 16/473; Y10T 16/509

See application file for complete search history.

(56) References Cited

U.S. PATENT DOCUMENTS

| | | | | | |
|---|---|---|---|---|---|
| 1,329,436 | A * | 2/1920 | Smiley | B66F 15/00 | 254/38 |
| 1,782,506 | A * | 11/1930 | Henderson | B25C 11/00 | 254/27 |
| 1,826,110 | A * | 10/1931 | Wickman | B66F 15/00 | 254/131 |
| 2,395,245 | A * | 2/1946 | Booharin | B25G 3/38 | 15/144.2 |
| 2,565,466 | A * | 8/1951 | Barker | A01B 1/222 | 294/57 |
| 3,076,263 | A * | 2/1963 | Musto | B26B 5/005 | 16/429 |
| 3,467,405 | A | 9/1969 | Fogg | | |
| 4,314,771 | A * | 2/1982 | Lambert | F16B 7/0426 | 16/429 |
| 5,447,289 | A * | 9/1995 | Callahan | B25C 11/00 | 254/131 |
| 6,354,570 | B1 * | 3/2002 | Christensen | B66F 15/00 | 254/131 |
| 6,786,472 | B1 | 9/2004 | Dahl | | |
| 6,945,334 | B2 * | 9/2005 | Grenner | A01B 1/16 | 172/378 |
| 2003/0208883 | A1 * | 11/2003 | Ruhland | B25G 1/04 | 16/422 |
| 2005/0046131 | A1 | 3/2005 | Gunderson | | |
| 2005/0120831 | A1 | 6/2005 | Parker et al. | | |
| 2008/0191181 | A1 * | 8/2008 | Verbowski | B25G 1/10 | 254/25 |
| 2010/0044657 | A1 * | 2/2010 | Patrick | B66F 15/00 | 254/130 |
| 2013/0125712 | A1 | 5/2013 | Yadlowsky et al. | | |

FOREIGN PATENT DOCUMENTS

| | | |
|---|---|---|
| WO | WO2004000715 | 12/2003 |

* cited by examiner

*Primary Examiner* — Tyrone V Hall, Jr.

(57) ABSTRACT

A pry bar assembly that has a removable handle includes a handle that may be manipulated. A prying unit is provided and the prying unit is removably coupled to the handle. The prying unit may engage an object thereby facilitating the prying unit to move the object when the handle is manipulated.

4 Claims, 4 Drawing Sheets

PRY BAR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to pry bar devices and more particularly pertains to a new pry bar device that has a removable handle.

BRIEF SUMMARY OF THE INVENTION

An embodiment of the disclosure meets the needs presented above by generally comprising a handle that may be manipulated. A prying unit is provided and the prying unit is removably coupled to the handle. The prying unit may engage an object thereby facilitating the prying unit to move the object when the handle is manipulated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
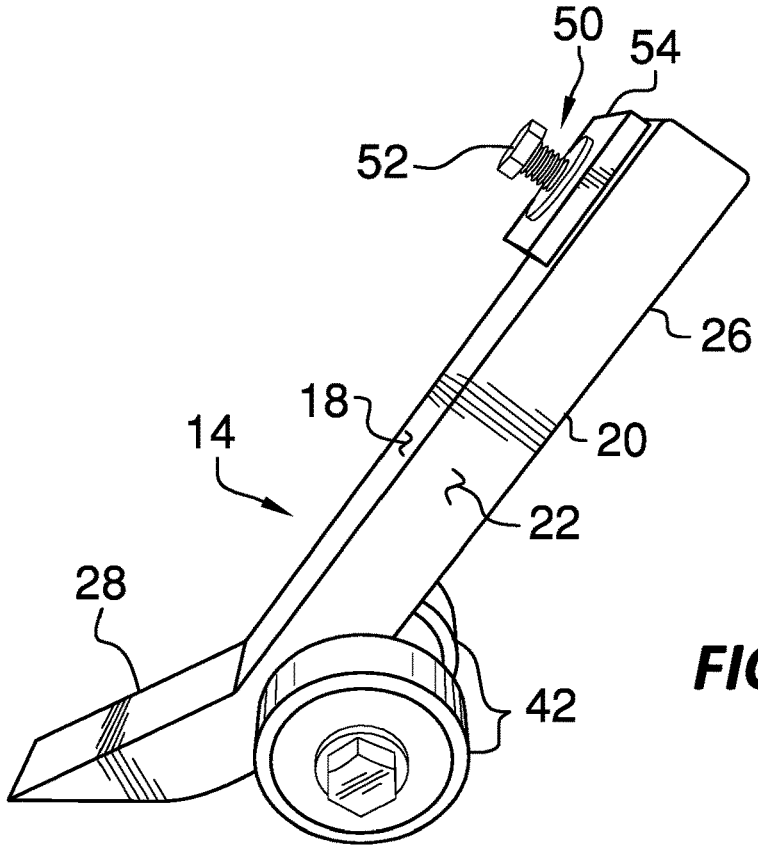
FIG. 1 is a perspective view of a pry bar assembly according to an embodiment of the disclosure.
Figure 2:
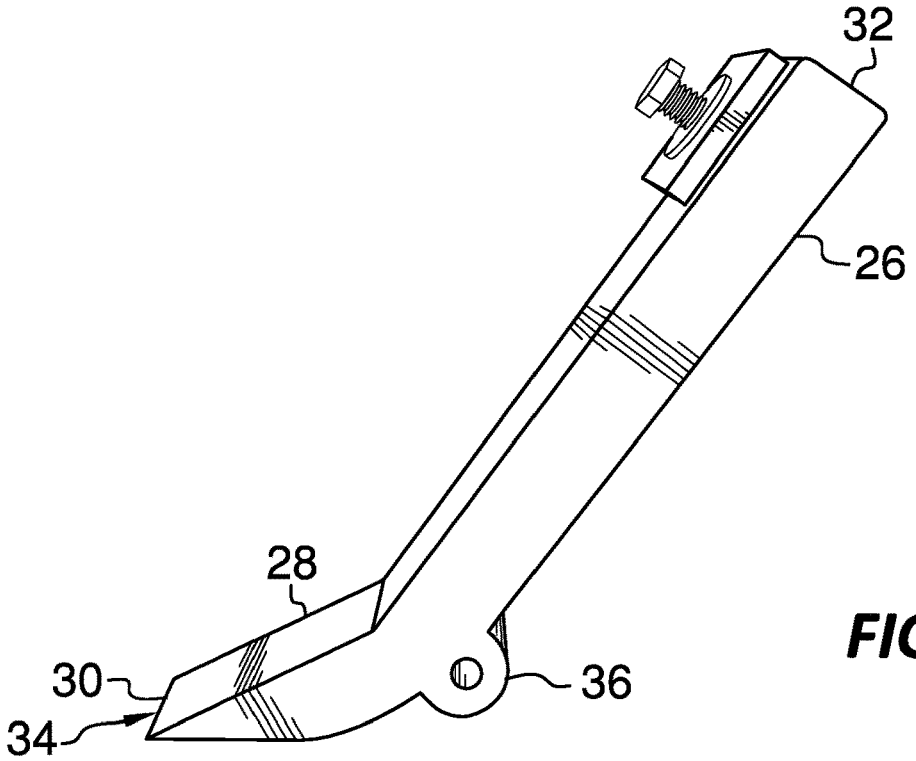
FIG. 2 is a left side perspective view of an embodiment of the disclosure.
Figure 3:
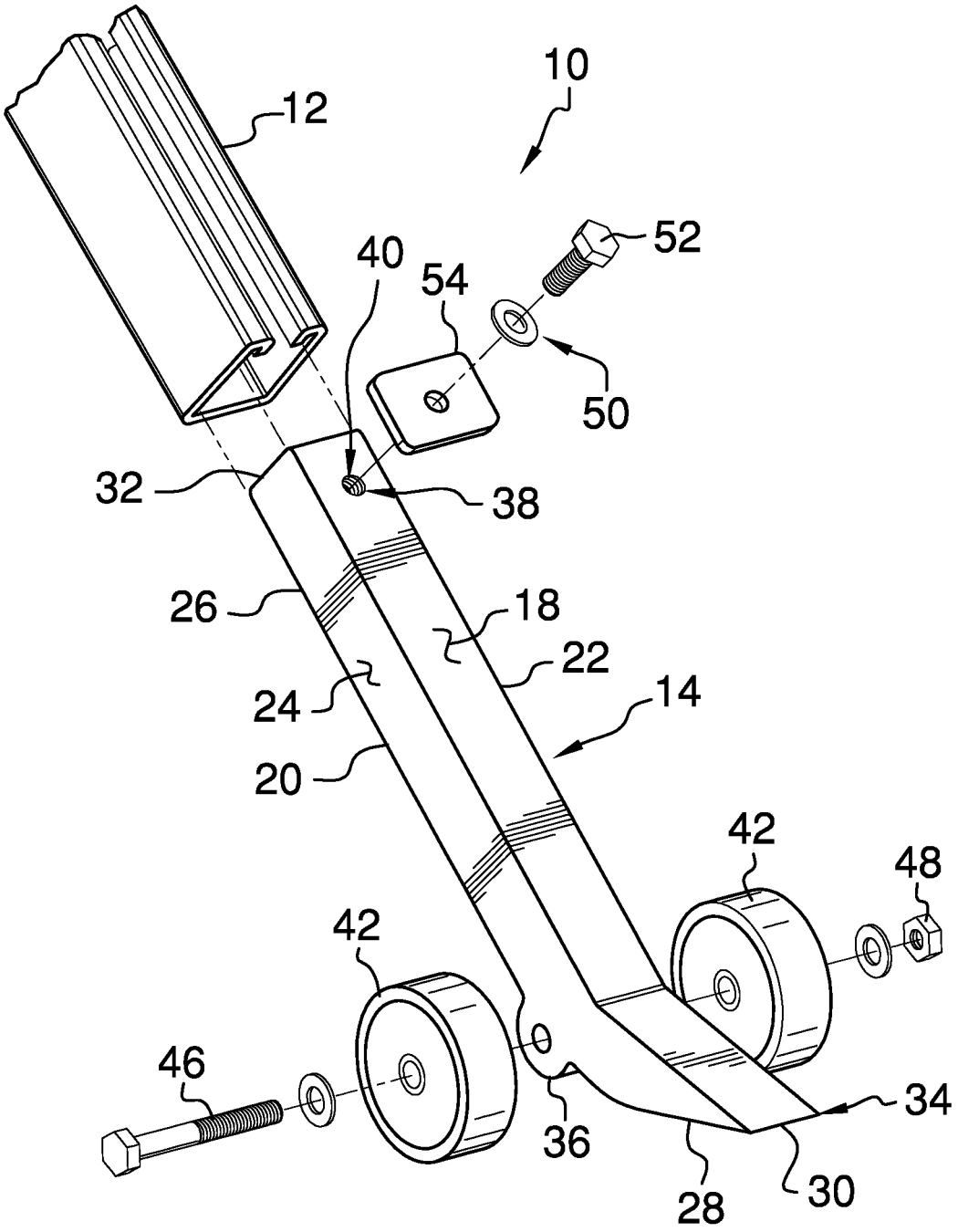
FIG. 3 is an exploded perspective view of an embodiment of the disclosure.
Figure 4:
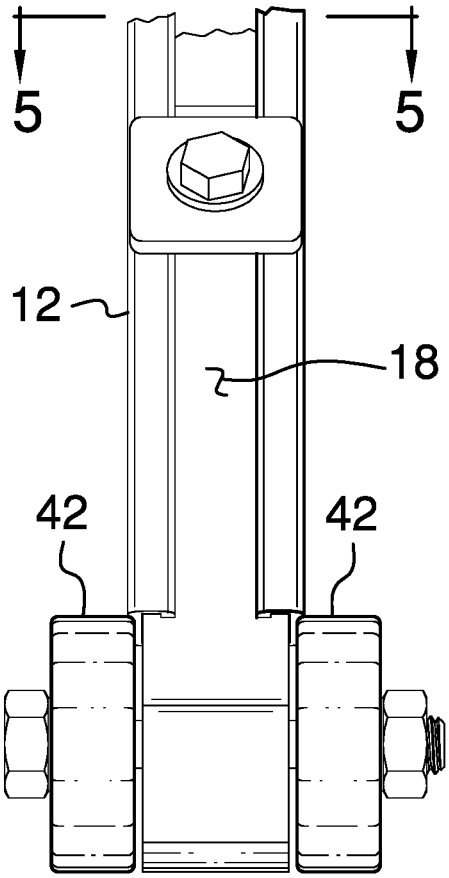
FIG. 4 is a front view of an embodiment of the disclosure.
Figure 5:
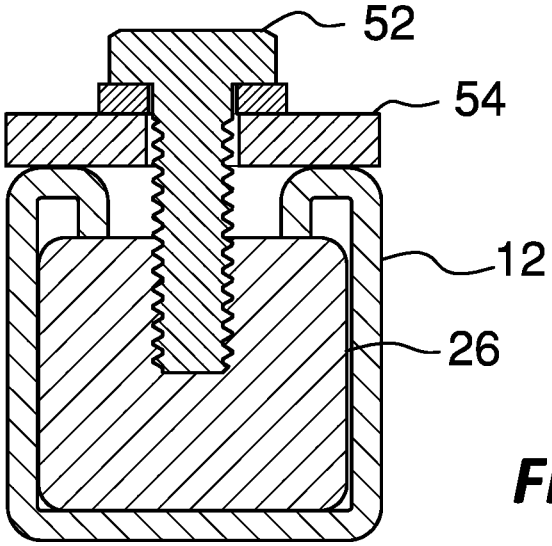
FIG. 5 is a cross sectional view taken along line 5-5 of FIG. 4 of an embodiment of the disclosure.
Figure 6:
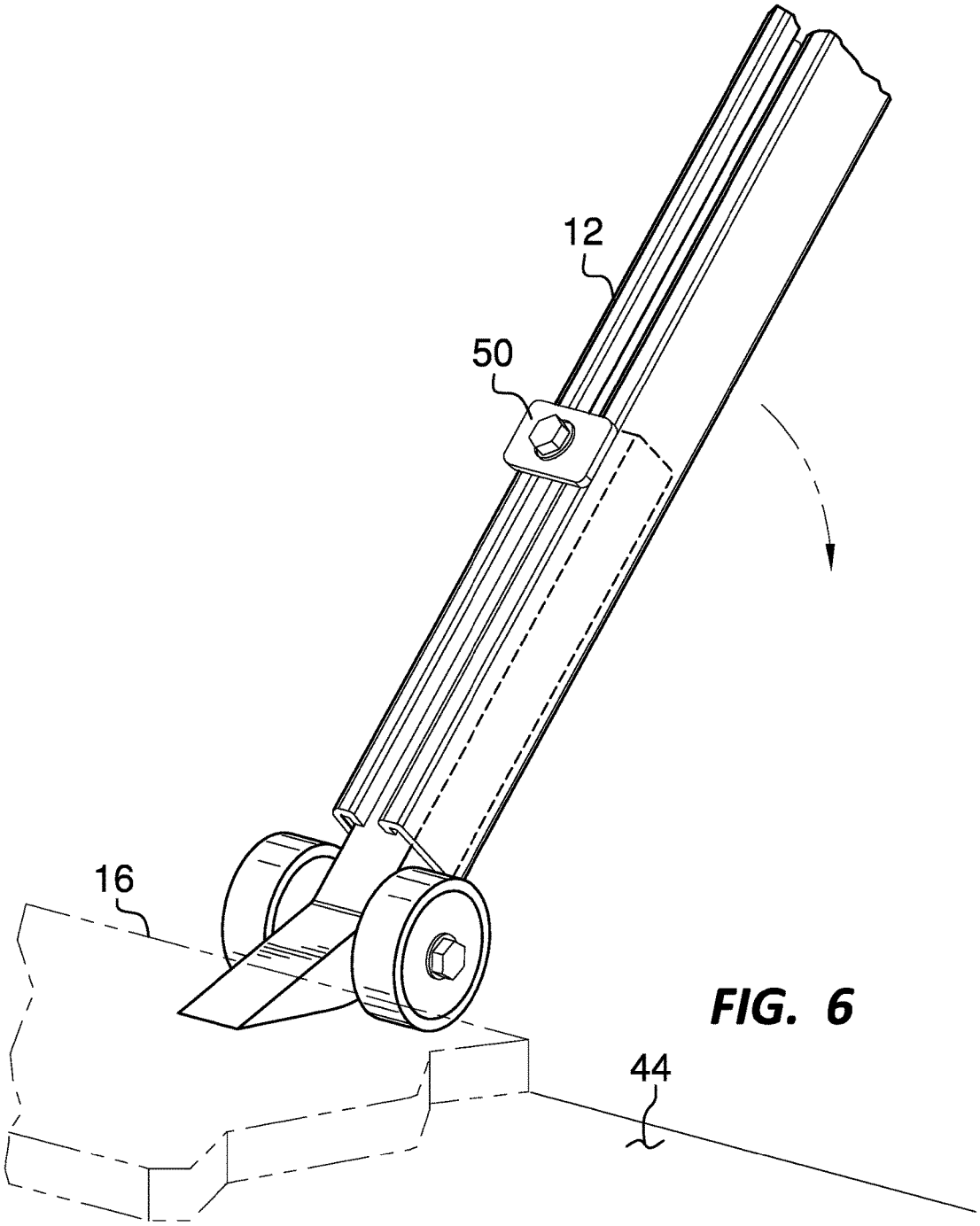
FIG. 6 is a perspective in-use view of an embodiment of the disclosure.

With reference now to the drawings, and in particular to FIGS. 1 through 6 thereof, a new pry bar device embodying the principles and concepts of an embodiment of the disclosure and generally designated by the reference numeral 10 will be described.

As best illustrated in FIGS. 1 through 6, the pry bar assembly 10 generally comprises a handle 12 that may be manipulated. The handle 12 is substantially hollow. The handle 12 may comprise a Unistrut framing member manufactured by Atkore Intl. 16100 South Lathrop Ave, Harvey, Ill. 60426. Moreover, the handle 12 may comprise any metallic framing member conventionally employed in commercial and residential construction.

A prying unit 14 is provided and the prying unit 14 is removably coupled to the handle 12. The prying unit 14 may engage an object 16 thereby facilitating the prying unit 14 to move the object 16 when the handle 12 is manipulated. The object 16 may be any object that is too heavy for a person to manipulate. The prying unit 14 has a front surface 18, a back surface 20, a first lateral surface 22 and a second lateral surface 24.

The prying unit 14 comprises a leg 26 and a foot 28. The foot 28 has a distal end 30 with respect to the leg 26 and the leg 26 has a distal end 32 with respect to the foot 28. The leg 26 is selectively inserted into the handle 12. The prying unit 14 may be selectively carried in a tool pouch or the like when the prying unit 14 is removed from the handle 12. The front surface 18 corresponding to the foot 28 intersects the back surface 20 corresponding to the foot 28 at the distal end 28 to define a wedge 34. The wedge 34 may be urged beneath the object 16 to lift the object 16. The wedge 34 may be urged between a pair of objects 16 to facilitate the pair of objects 16 to be urged apart from one another.

The back surface 20 has a lobe 36 extending outwardly therefrom and the lobe 36 is positioned at an intersection of the leg 26 and the foot 28. The front surface 18 has a well 38 extending toward the back surface 20. The well 38 is positioned proximate the distal end 32 of the leg 26. The well 38 has a bounding surface 40 and the bounding surface 40 is threaded.

A pair of wheels 42 is provided and each of the wheels 42 is rotatably coupled to the lobe 36. Each of the wheels 42 may roll on a support surface 44 when the wedge 34 is urged beneath the object 16. Thus, the wheels 42 facilitate the prying unit 14 to lift the object 16 when the handle 12 is manipulated. The wheels 42 are positioned on an associated one of the first lateral surface 22 and the second lateral surface 24. Each of the wheels 42 may comprise metallic wheels or the like thereby enhancing load bearing capabilities of the wheels 42. The support surface 44 may comprise ground.

A bolt 46 and a nut 48 may be provided. The bolt 46 may extend through each of the wheels 42 and the lobe 36. The nut 48 may engage the bolt 46 when the bolt 46 is extended through wheels 42 and the lobe 36. Thus, the wheels 42 may be removably retained on the prying unit 14.

A fastener 50 is provided and the fastener 50 threadably engages the bounding surface 40 of the well 38. The fastener 50 frictionally engages the handle 12 when the leg 26 is inserted into the handle 12. Thus, the prying unit 14 is removably retained on the handle 12. The fastener 50 may include a bolt 52 and a plate 54. The plate 54 may be positioned to frictionally engage the handle 12 when the prying unit 14 is inserted into the handle 12. The bolt 52 may extend through the plate 54 and threadably engage the bounding surface 40. Thus, the plate 54 may be compressed against the handle 12 thereby retaining the prying unit 14 in the handle 12.

In use, the leg 26 of the prying unit 14 is inserted into the handle 12. The handle 12 may be cut to a desired length thereby facilitating the prying unit 14 to be manipulated in an otherwise inaccessible location. The wedge 34 is urged between the object 16 and the support surface 44, and the handle 12 is manipulated to lift the object 16. The wheels 42 act as a fulcrum when the handle 12 is manipulated to lift the object 16. Additionally, the wheels facilitate the object 16 may be rolled along the support surface 44 when the object 16 is lifted. The prying unit 14 is stored in a tool bag or the like when the prying unit 14 is not coupled to the handle 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A pry bar assembly having a removable handle, said assembly comprising:

a handle; and a prying unit being removably coupled to said handle, said prying unit being configured to engage an object thereby facilitating said prying unit to move the object when said handle is manipulated, wherein said prying unit comprises a front surface, a back surface, a leg and a foot, said foot being an integral extension of said leg, said foot having a distal end with respect to said leg, said leg having a distal end with respect to said foot, said leg being selectively inserted into said handle, said front surface corresponding to said foot intersecting said back surface corresponding to said foot at said distal end of said foot to define a wedge;

a lobe integrally extending outwardly from said back surface of said prying unit, said lobe being in a fixed position at an intersection of said leg and said foot;

a pair of wheels, each of said wheels being rotatably coupled to said prying unit such that each of said wheels is configured to roll on a support surface when said wedge is urged beneath the object thereby facilitating said prying unit to lift the object when said handle is manipulated, said wheels being positioned on an associated one of a first lateral surface of said prying unit and a second lateral surface of said prying unit, each of said wheels being aligned with and extending laterally from said lobe wherein said wheels are rearwardly offset from a longitudinal central axis of said leg and a forward surface of said prying unit is forwardly spaced from an outer circumference of each of said wheels.

2. The assembly according to claim 1, wherein said front surface having a well extending toward said back surface, said well being positioned proximate said distal end of said leg, said well having a bounding surface, said bounding surface being threaded.

3. The assembly according to claim 2, further comprising a fastener threadedly engaging said bounding surface of said well, said fastener engaging said handle when said leg is inserted into said handle such that said prying unit is removably retained on said handle.

4. A pry bar assembly having a removable handle, said assembly comprising:

a handle being configured to be manipulated, said handle being substantially hollow; and a prying unit being removably coupled to said handle, said prying unit being configured to engage an object thereby facilitating said prying unit to move the object when said handle is manipulated, said prying unit having a front surface, a back surface, a first lateral surface and a second lateral surface, said prying unit comprising a leg and a foot, said foot having a distal end with respect to said leg, said leg having a distal end with respect to said foot, said leg being selectively inserted into said handle, said front surface corresponding to said foot intersecting said back surface corresponding to said foot at said distal end to define a wedge, said front surface having a well extending toward said back surface, said well being positioned proximate said distal end of said leg, said well having a bounding surface, said bounding surface being threaded;

a lobe integrally extending outwardly from said back surface of said prying unit, said lobe being in a fixed position at an intersection of said leg and said foot;

a pair of wheels, each of said wheels being rotatably coupled to said prying unit wherein each of said wheels is configured to roll on a support surface when said wedge is urged beneath the object thereby facilitating said prying unit to lift the object when said handle is manipulated, said wheels being positioned on an associated one of said first lateral surface and said second lateral surface, each of said wheels being aligned with and extending laterally from said lobe wherein said wheels are rearwardly offset from a longitudinal central axis of said leg and a forward surface of said prying unit is forwardly spaced from an outer circumference of each of said wheels; and a fastener threadably engaging said bounding surface of said well, said fastener engaging said handle when said leg is inserted into said handle such that said prying unit is removably retained on said handle.

* * * * *